United States Patent [19]

Vidal et al.

[11] Patent Number: 4,911,585

[45] Date of Patent: Mar. 27, 1990

[54] WALL SYSTEMS

[75] Inventors: Henri Vidal, 8 Bis, Boulevard Maillot, 92200 Neuilly-sur-Seine, France; David P. McKittrick, McLean, Va.; Longine J. Wojciechowski, Potomac, Md.

[73] Assignee: Henri Vidal, Neuilly-sur-Seine, France

[21] Appl. No.: 350,911

[22] Filed: May 12, 1989

[30] Foreign Application Priority Data

May 13, 1988 [GB] United Kingdom ..... 8811376

[51] Int. Cl.[4] ..... E02D 29/00

[52] U.S. Cl. ..... 405/287; 405/258; 405/284

[58] Field of Search ..... 405/284, 285, 286, 287, 405/258, 262, 272, 273

[56] References Cited

U.S. PATENT DOCUMENTS

| | | | |
|---|---|---|---|
| 2,420,228 | 5/1947 | Condon | 405/286 |
| 3,195,312 | 7/1965 | Rumsey | 405/287 |
| 4,564,316 | 1/1986 | Hunziker | 405/262 |
| 4,592,678 | 6/1986 | McNinch et al. | 405/284 |
| 4,643,618 | 2/1987 | Hilfiker et al. | 405/284 X |
| 4,653,962 | 3/1987 | McKittrick et al. | 405/284 X |
| 4,684,294 | 8/1987 | O'Neill | 405/284 X |

FOREIGN PATENT DOCUMENTS

| | | | |
|---|---|---|---|
| 0119831 | 9/1980 | Japan | 405/284 |

*Primary Examiner*—Dennis L. Taylor

*Attorney, Agent, or Firm*—Burns, Doane, Swecker & Mathis

[57] ABSTRACT

A retaining wall comprises a facing, a counterfort connected to the rear of the facing, a footing supporting the facing and the counterfort, backfill behind the facing to provide a support surface for traffic, and a traffic barrier along the top of the wall. The counterfort comprises a reinforced concrete slab having a substantially vertical front portion at right angles to a base portion, and a rear portion running from substantially the top of the counterfort to the rear of the base portion thereof, the angle between the rear portion and the front portion being smaller in the vicinity of the top of the counterfort than in the vicinity of the base. The counterfort and the traffic barrier are connected to each other such that impact loads on the traffic barrier are transferred directly to the footing. The facing comprises a plurality of substantially vertical wall elements supported side-by-side on the footing, at least one height adjustment means at the lower edge of each wall element for adjusting the orientation of the element in a lateral plane during construction, and connecting means between adjacent elements which are adjustable during construction in a first direction to vary the compression of seal means between the elements and in a second direction to adjust the relative vertical positions of the adjacent elements.

11 Claims, 5 Drawing Sheets

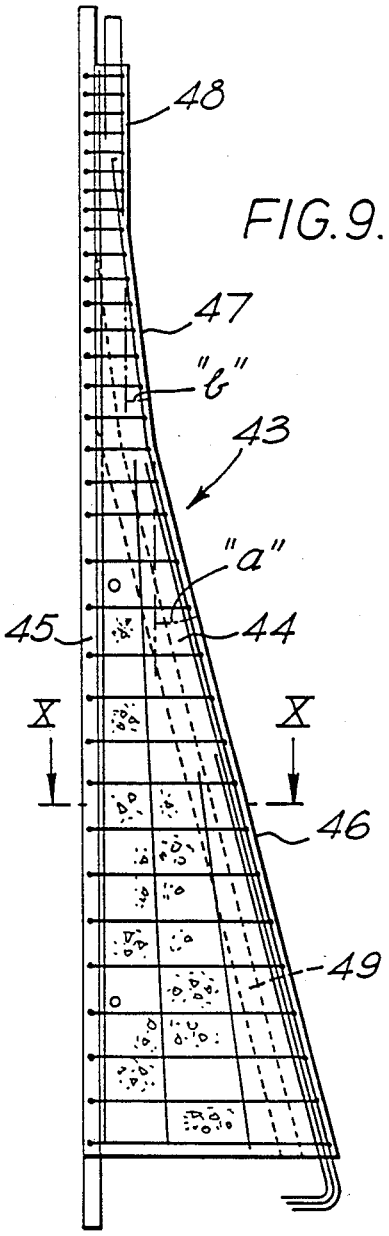
FIG.9.
FIG.10.
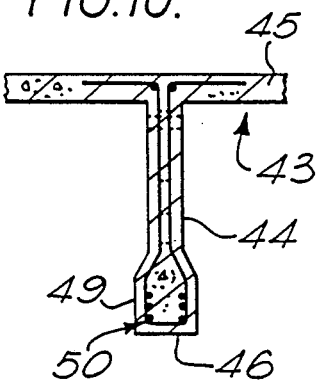

WALL SYSTEMS

This invention relates to retaining wall systems.

In recent years, retaining walls for earth-works have tended to avoid massive gravity-wall systems on economic grounds and there has been a trend towards relatively light walls held in place by reinforcements embedded in the earth mass. However, such reinforcement generally requires the reinforcing members to extend at least beyond the conventional Coulomb failure wedge, commonly to a distance of several meters. In the construction of roads and other structures, particularly in an urban environment, there is frequently insufficient room to introduce stabilising members of adequate length between the front of the wall, as designed, and the stable earth or rock mass created by excavation, while further excavation would be unacceptably costly. Under these circumstances, one type of retaining wall system which can be introduced comprises a substantial footing extending rearwards and/or forwards from the front of the wall, the width of which may be as much as about half the height of the wall, this footing carrying a relatively thin wall supported by counterforts. In such a system, the horizontal components of the earth pressure acting on the upper parts of the wall which would tend to cause overturning, are balanced by the vertical components of the earth pressure vertically downwards on the footing.

Such systems are normally constructed from reinforced-concrete. The amount of steel present in the facing, the footing and, in particular, in the counterforts must be more than adequate to resist any forces generated by earth pressure and any design loads such as traffic. Because of the high cost of steel and concrete, it is important to design the wall in such a way that the use of steel and concrete is optimised.

The counterfort can be considered to act as a cantilever resisting bending moments which are the resultants of earth pressures and design loads acting from the rear and, in some instances, forces acting on the front of the wall. Some prior counterforts for walls of the above kind have been of substantially uniform cross-section from top to bottom but more recently such counterforts have been designed to taper uniformly from the bottom where they are widest to the top where they are narrower.

We have calculated that, although such tapering can reduce the amount of concrete in the counterforts, still further concrete can be saved if the angle of taper of the counterfort, that is the angle between the rear surface and the facing, is smaller at the top than at the bottom. It is difficult to calculate accurately the resultant horizontal component of the earth pressure and other forces acting on the wall at any particular height but it has previously been the practice to assume an approximately linear reduction with height, leading to the simple tapered counterforts described above. It appears, however, that while it is necessary for a high wall that the base of the counterfort should extend well behind the facing, for example a distance of at least about 0.36H where H is the height of the wall, it is not necessary over the upper section of the counterfort to provide a simple taper at an angle $\tan^{-1} 0.33$, and a lower taper angle is adequate. For example a zero taper angle may be provided, i.e. the counterfort may be formed in its upper section with its rear portion parallel to its front portion. By combining a wide angle lower section with a narrower or zero angle upper section, it is possible to design a counterfort of sufficient strength to support the wall, while containing significantly less concrete, for example 10% less. Therefore, the shape of the counterfort is such that the resulting element is highly efficient relative to standard cast in place concrete counted units.

In particular by ideally shaping the counterfort to simulate the parabolic line relating to the wall bending moments, it is possible to avoid the use of unnecessary concrete and produce the most efficient concrete element. In addition, another benefit is that this efficient element is less rigid than the massive, inefficient counterforts previously utilized. The enhanced flexibility will result in the generation of a lower state of stress in the soil behind the wall, approximating the active earth pressure condition. Conversely, the excessive rigidity of previous systems generated an at-rest earth pressure condition, which is significantly higher.

It is also important that the wall elements are accurately aligned both vertically and horizontally, in order to maintain a high standard of architectural finish. In order to ensure that adjacent elements are correctly positioned in a lateral plane prior to being secured in position it is feature of the invention to provide adjustment means at one or more positions on the lower edges of the elements.

In addition to adjustment of each wall element relative to the support surface it is also important to be able to connect together adjacent elements by a form of connection which permits relative vertical movement between the elements before they are finally secured in position and which will both allow alignment of the elements in the longitudinal direction and prevent lateral movement of individual panels.

Thus the invention provides a retaining wall comprising a facing, a counterfort connected to the rear of the facing, and a footing supporting the facing and the counterfort, wherein: the counterfort comprises a reinforced concrete slab having opposed substantially flat sides and a base portion joined to the footing, a front portion at right angles to said base portion, said front portion being substantially longer than said base portion, and a rear portion running from substantially the top of the counterfort to the rear of the base portion thereof, the angle between the rear portion and the front portion being smaller in the vicinity of the top of the counterfort than in the vicinity of the base; and wherein the facing comprises a plurality of substantially vertical wall elements supported side-by-side on the footing, at least one height adjustment means at the lower edge of each wall element for adjusting the orientation of the element in a lateral plane during construction, connecting means for connecting adjacent elements along substantially vertical side edges thereof, and seal means compressed between such side edges, the connecting means being adjustable during construction in a first direction to vary the compression of the seal means and in a second direction to adjust the relative vertical positions of adjacent elements.

We have found that for high walls, the rear of the counterfort should preferably be at a distance 0.13H to 0.18H behind the rear side of the facing panel, where H is the height of the wall. The height of the counterfort may be slightly less than the height of the wall, for example, 0.90 to 0.95H. As indicated above, if such a relatively wide based counterfort is in the form of a simple right-angled triangle, the amount of concrete required may be unduly costly. It is possible to overcome this problem by, in effect, subtracting from the simple triangular shape a proportion of the concrete in the upper part of the counterfort, where forces acting on the counterfort and adjacent areas of the facing are less than on the lower part. The shape of the counterfort thus approximates the parabolic line relating to the bending moments for the loads on the wall.

Thus, if the rear surface of the lower part of the counterfort from the footing to a point in the region 0.5H to 0.63H is at an angle between $\tan^{-1} 0.13$ and $\tan^{-1} 0.25$ to the vertical, the rear surface of the counterfort above that point may be at an angle between zero and $\tan^{-1} 0.18$ to the vertical. The change in the taper angle of the counterfort may advantageously be at a height in the range 0.5H to 0.75H, more preferably 0.6H to 0.7H. In a preferred wall where the height H is approximately 4 m the change in angle occurs at a height of 0.46H, the taper angle below this point being $\tan^{-1} 0.13$ and above this point being zero.

There may be a single change in the angle of the rear surface of the counterfort, so that the surface has, in effect, lower and upper parts each at a different angle. It is however desirable for higher walls, e.g. 6 to 9 meters or more, to provide two such changes in angle, so that the counterfort then has a lower part, an intermediate part, and an upper part. This allows the counterfort profile to follow even more closely the bending moment envelope caused by the loading on the structure and so produce savings in materials. The angle to the vertical for example may be $\tan^{-1} 0.25$ for the lower part and $\tan^{-1} 0.13$ for the intermediate part, whilst the upper part may itself be vertical, i.e. a zero taper angle. The change in taper angle between the lower and intermediate parts may occur at about 0.6H where H is the height of the wall, whilst the change in the taper angle between the intermediate and upper parts may occur at about 0.8H.

The positioning of the steel reinforcements in the counterforts is important and in general there will be more longitudinal, approximately vertical steel reinforcements incorporated in the lower part of the counterfort securing that part of the wall where overturning forces are greatest. Furthermore, such vertical steel reinforcements are preferably in greater concentration at the rear of the counterfort, where they can best resist tensile forces, although reinforcements will normally also run approximately vertically at intermediate positions nearer the facing panel. Substantially horizontal steel stirrups will be incorporated at intervals and will link and secure the vertical reinforcements.

The longitudinal, tensile reinforcements close to the rear of the counterfort will change direction at the point where the external shape of the counterfort changes angle, being generally about 5–10 cm from the concrete surface. This means that the length of steel running vertically at the rear of the counterfort is longer than if a plain triangular shape were employed but the cost of this is more than compensated by the saving in concrete.

It is additionally possible to save concrete by designing the counterfort to be somewhat thinner near to the facing where the compressive and tensile forces are lower than at the rear of the counterfort. In general, it is possible to reduce the thickness (i.e. the lateral dimension parallel to the facing) of the counterfort near the facing to about 65–75% of that at the rear without significant loss of strength. Thus, a preferred form of counterfort according to the invention comprises, in effect, a flange at the rear of the structure carrying at least 50% of the total longitudinal reinforcing steel, and being of approximately square cross-section joined to the facing by a web of thinner reinforced concrete carrying only nominal reinforcing steel the thickness of this web being 65–75% of the thickness of the rearward flange.

In special applications, it may be possible to cast the counterforts in such a way as to void or "block out" concrete in those areas where tensile stress requirements are minimal. This detail will save concrete quantity and thereby reduce the weight of the counterfort. It will also provide an area through which longitudinal piping for drainage can be placed.

The counterforts according to the invention may be cast integrally with the facing or may be secured thereto, for example by bolting hardened cantilever counterforts to a hardened concrete facing.

Where the facing is to be integral with the counterforts they may be cast together at the same time i.e. monolithically poured. Alternatively the counterforts may conveniently be cast first with reinforcing steel protruding an appropriate distance out from the front edge to b integrated with the facing. Such protruding reinforcing steel will normally take the form of the ends of stirrups, which stirrups continue to the rear of the counterfort and effectively circumscribe and link the essentially vertical reinforcing bars. The facing panel will then be cast, normally with a single layer of reinforcing bars or welded wiremesh. The facing panel will conveniently have at least two counterforts so spaced that when like panels are assembled to form a wall, the counterforts are spaced in such a manner that the mid-span moments in the facing panel equal zero. This allows for utilization of a thin concrete facing.

The counterforts assembled together with facing panels will normally be secured to a footing by casting the latter integrally therewith. In general, the width (the dimension from front to rear) of the footing will be of the order of 60% of the wall height. The footing will normally have a heel extending rearwardly of the wall and a toe extending forwardly. The proportions of the footing width made up by the heel and toe will depend on the type of load (level surcharge, slope surcharge) and the space available on site.

During construction, a shear key is preferably cast on site. This pad initially serves as a levelling pad to support the precast wall elements consisting of the counterforts and facing. Eventually, the footing will be poured on top of this key and it may be convenient for steel reinforcements to protrude upwards from the key so that the latter is eventually integrated with the footing. To reduce bearing pressure under the toe, it may be advantageous for the above key to be replaced by a distribution slab which will serve to distribute the very large forces exerted vertically downwards by the retaining wall. The horizontal component of the soil pressure acting on the upper parts of the facing panel will exert a large turning moment at the toe of the footing which thus creates a large downward vertical force. The higher the wall, the greater this turning moment and the greater the downward bearing pressure. In such cases, it is preferable to distribute the downward force uniformly by providing a substantial distribution slab. For a wall as high as 10 meters, such a distribution slab may be of the order of 50–60% of the footing width. The centre of the distribution slab should be placed approximately below the vertical resultant of all loads acting in the system, which will normally be between the facing and the rearmost part of the counterforts. In a preferred form, if 'W' is the width of the retaining wall footing, the distribution slab should extend a distance about 0.2W beyond the front of the facing, while the rear part of the slab should extend about 0.5W behind that point.

By providing at least one height adjustment means at the lower edge of each wall element making up the facing for adjusting the orientation of the element in a lateral plane during construction, the wall elements may be adjusted to the correct position, normally such that their abutting side edges are vertical, before being secured in position. If more than one height adjustment means is provided for each wall element then their height as well as orientation may be adjusted.

The height adjustment means can conveniently comprise erection bolts and bearing plates which can be used to increase or decrease the distance between the lowermost point on the wall element and the support surface, which may be a shear key or distribution slab below. The erection bolt(s) may extend vertically downwards from the lower edge of the wall element, or alternatively upwards from the support surface. These erection bolts make the utilization of the system for large walls in excess of 7 meters practical due to to the tolerances in pre-cast concrete which may thus be accommodated. Each wall element will normally include a facing panel having a pair of laterally spaced legs, and advantageously an erection bolt projects downwardly from each such leg. One or more counterforts may be provided to support the facing panel and these may include reinforcement projecting downwardly therefrom to assist the element in standing upright and to be embedded in concrete poured to form the footing.

In order to ensure the correct position of the wall elements in the forward and rearward direction, it is advantageous to provide temporary bracing means secured at one end to a point relatively high on the front or rear of the element and at the other end to retaining means embedded in the ground, in the footings or to a mass of sufficient size to assume temporary stability. Such bracing means can be provided with a screw adjustment to facilitate accurate alignment of the tops of the elements. Since such bracing means may be of considerable length and thus subject to bending under their own weight, the accuracy of the alignment may be improved by supporting the central region of the bracing member with a strut which engages with a suitable point on the rear of the elements. When the tops of the elements are accurately aligned and the erection bolts have ensured that the edges of the panels are vertical, the concrete of the footing may be poured to provide an L-shaped wall which advantageously is stiffened by counterforts provided behind facing panels of the wall.

Subsequently, the wall can be backfilled with suitable material. Where the water drainage problem is serious, the backfill immediately behind the panels may be selected for its drainage and/or filtration properties. Such backfill may continue to approximately level with the top of the wall or may extend even higher as a surcharge.

The connecting means for connecting adjacent wall elements along substantially vertical side edges thereof may for example comprise a connecting plate secured to the rear of adjacent wall elements, the plate being formed with a horizontal slot through which passes fastening means e.g. a bolt connected to one of the elements, and being formed with a vertical slot through which passes fastening means connected to the adjacent element. In such an arrangement the horizontal slot enables adjustment in the first direction, i.e. movement of the element side edges towards and away from each other, whilst the vertical slot enables relative vertical adjustment of the adjacent elements.

An alternative form of connecting means comprises a pair of angle brackets each secured to the rear of a respective adjacent wall element with rearward projecting limbs of the brackets facing each other, each such limb being formed with an opening through which fastening means e.g. a bolt extends, the opening of one limb comprising a vertical slot and the opening of the other limb comprising a horizontal slot. In this arrangement adjustment of the fastening means, such as by rotating a nut on the bolt, effects movement of the element side edges towards and away from each other; adjustment of the fastening means in the vertical slot effects relative vertical movement of the adjacent elements; and adjustment of the fastening means in the horizontal slot provides relative forward and rearward movement of the adjacent elements. Thus in this preferred form of connection relative adjustment of adjacent wall elements is possible in three vertically perpendicular directions.

A further problem in the construction of retaining walls intended to retain backfill for supporting a roadway or the like is the manner in which a barrier, for example a traffic barrier, may be secured to the structure. The barrier is normally located along the facing but if it is secured to the facing then the latter must be sufficiently strong to withstand loads resulting from impacts on the barrier. The facing must then be relatively thick or heavily reinforced.

Accordingly, the retaining wall preferably comprises backfill behind the facing to provide a support surface e.g. for traffic, and a barrier along the top of the wall, the counterfort and the barrier being connected to each other whereby any impact loads on the barrier are transferred directly to the concrete footing. This assists in absorbing and resisting such impact loads.

In such a retaining wall the barrier is securely connected to the counterfort, so that impact loads or the barrier may be transferred directly to the counterfort. Thus the facing itself need not be designed to withstand such impact loads and can be relatively lightweight to give savings in the material from which the facing is made, usually concrete and steel. The counterfort will normally be connected to a substantial footing to which the impact loads are transferred from the counterfort.

Preferably both the counterfort and the barrier are initially provided with reinforcement projecting therefrom, and the counterfort and the barrier are connected to each other by a cast-in-place concrete junction member in which the reinforcement projecting from the counterfort and that projecting from the barrier are embedded.

The barrier will thus normally be formed of reinforced concrete and may either be precast with projecting reinforcement to be embedded in the junction member, or cast-in-place at the same time as, or subsequent to, casting of the junction member. In either case reinforcement will extend between the barrier and the junction member to provide a secure connection.

Preferably the facing extends to a greater height than the counterfort and the junction member is located in the region defined above the counterfort and behind the facing. The precast barrier will normally rest on top of the facing, possibly with a fill layer therebetween, and in such circumstances the barrier projecting portion will extend downwardly towards the counterfort into said region, whilst the projecting reinforcement of the counterfort will extend upwardly into said region.

The facing may take the form of a panel supported by two or more laterally spaced counterforts, in which case it may be advantageous to form the junction member as a beam spanning the counterforts. Normally a plurality of facing panels will be arranged in a row so that the junction member is cast as a continuous beam along the wall. It may be advantageous to mount precast barrier units to span the junctions between adjacent wall panels to secure these against relative movement.

Some preferred embodiments of the invention will now be described by way of example and with reference to the accompanying drawings, in which:

FIG. 9 is a side elevation of a wall element comprising a counterfort and facing panel cast at the same time;

FIG. 10 is a section on the lines X—X of FIG. 9;

Figure 1:
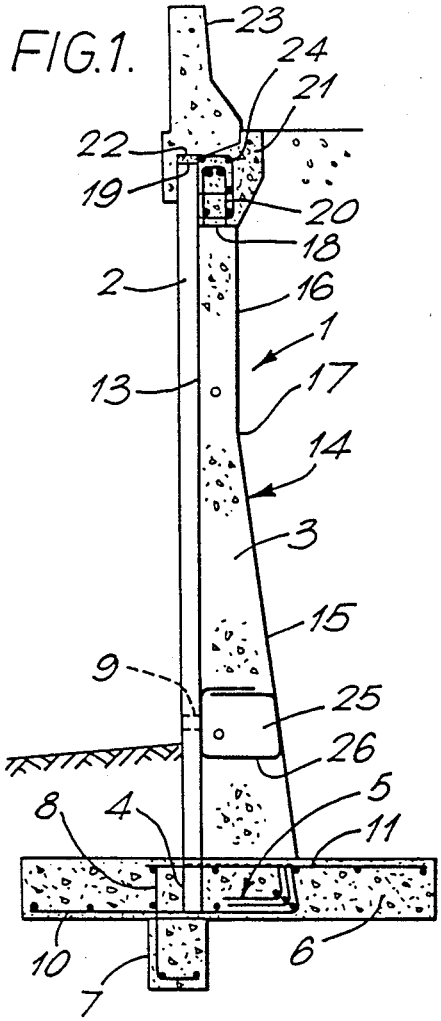
FIG. 1 is a side elevation, partly in section, of a retaining wall having a precast traffic barrier.

Referring to FIGS. 1 to 4, a reinforced concrete retaining wall element 1 comprises a facing panel 2 having a pair of rearwardly extending counterforts 3.

The facing panel has a pair of laterally spaced legs 4 and each counterfort has a plurality of downwardly projecting reinforcing bars 5. The panel legs 4 and the counterfort bars 5 are arranged to support the wall element 1 in an upright position during construction and are embedded in a footing 6. A shear key 7 is located beneath the panel legs 4 and is integrally connected to the footing 6 by a plurality of upwardly projecting reinforcing bars 8. The footing 6, cast after the shear key 7 is in place and has hardened, includes in the lower region of its toe reinforcement 10 and in the upper region of its heel reinforcement 11.

Each counterfort has a vertically extending front portion 13 and a rear portion 14 which consists of a lower part 15 at an angle to the front portion and an upper part 16 parallel to the front portion. The counterfort is thus of maximum depth at its base where the bending moment produced by backfill forces is likely to be a maximum, and reduces to its minimum depth at an intermediate level defined by a junction 17 between the lower and upper parts 15,16 of the counterfort. The depth of the counterfort from the junction 17 to the top 18 of the counterfort is constant.

As seen in FIG. 1 the top 18 of each counterfort is located below the level of the top 19 of the facing panel 2. Steel reinforcement 20 projects upwardly from the counterfort and is embedded in a concrete junction beam 21 which is cast-in-place once the wall element has been backfilled. A cast-in-place concrete fill layer 22 is provided on the top 19 of the facing panel to provide location for a traffic barrier 23 which is pre-cast with steel reinforcement 24 projecting downwardly from its rear portion. This reinforcement 24 is arranged to fit behind the facing panel and is embedded in the concrete of the junction beam 21. Thus a direct reinforced concrete connection is formed between the traffic barrier 23 and the counterfort 3 so that in use impact loads on the traffic barrier are transferred through the counterforts into the footing of the retaining wall.

The facing panel 2 of the wall element is provided with at least one weephole 9 behind which is placed drainage stone 25 wrapped in geotextile fabric 26 located between the counterforts. This arrangement allows drainage of the backfill behind the wall. In an alternative construction the weepholes in the wall may be omitted and replaced with a PVC drainage pipe system extending the length of the wall.

Lifting holes about 2 inches (5 cm) in diameter may advantageously be present in the counterforts for example about 0.3H and 0.6H from the base, where H is height of the wall.

Figure 2:
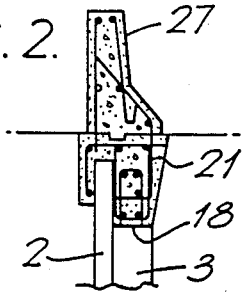
FIG. 2 is a side elevation, partly in section, of a cast-in-place traffic barrier.

FIG. 2 shows the use of a cast-in-place traffic barrier 27 rather than a precast traffic barrier. This involves casting of the traffic barrier on site at the same time as or after casting the junction beam, and also provides a direct reinforced concrete connection between the traffic barrier 27 and the counterfort 3.

Figure 4:
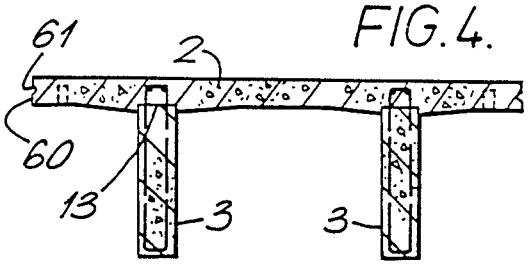
FIG. 4 is a section on the lines IV—IV of FIG. 3.
Figure 3:
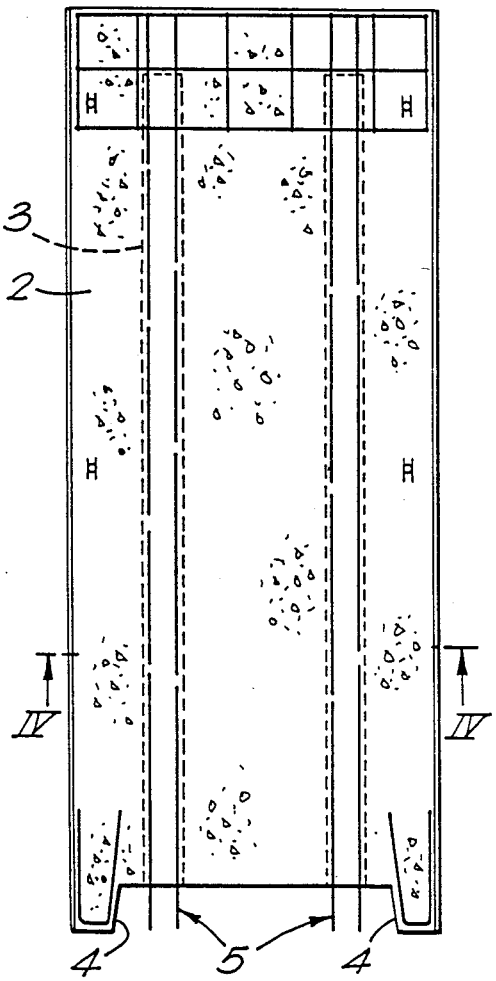
FIG. 3 is a rear view of a facing panel for a retaining wall similar to that of FIG. 1.

Referring to FIG. 4, each side edge 60 of the facing panel 2 is formed with a vertically extending slot 61 for receiving a sealing member to be described later.

Figure 5:
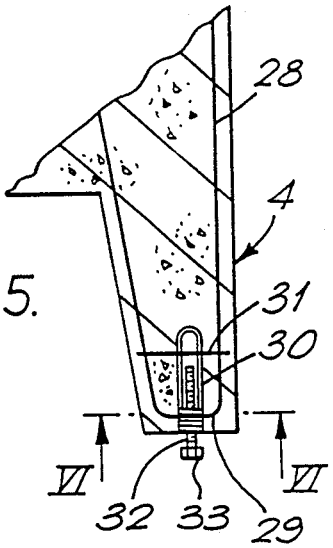
FIG. 5 is an enlarged view of a leg of the facing panel shown in FIG. 3, showing details of the erection bolt.
Figure 6:
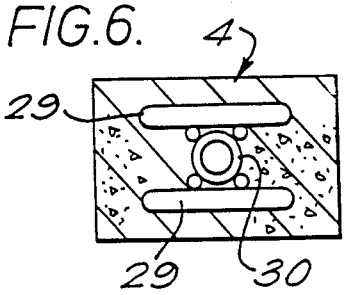
FIG. 6 is a section on the lines VI—VI of FIG. 5.

The facing panel legs 4 will now be described in greater detail with reference to FIGS. 5 and 6. Each leg 4 is reinforced by a pair of "U" shaped bars 28 each having a lower horizontal portion 29 to which a coil insert 30 is tack welded. The coil insert is also tack welded to a pair of cross bars 31 each extending between the two arms of a respective "U" bar 28. An erection bolt 32 threadedly engages the coil insert 30 and has a head 33 which may be engaged and rotated to move the bolt up or down. When the wall element is in the upright position the erection bolts protruding from the panel legs 4 rest on the shear key 7 prior to casting of the footing 6, and by appropriate adjustment of the bolts the element may be accurately positioned ready for pouring of the concrete to form the footing.

Figure 7:
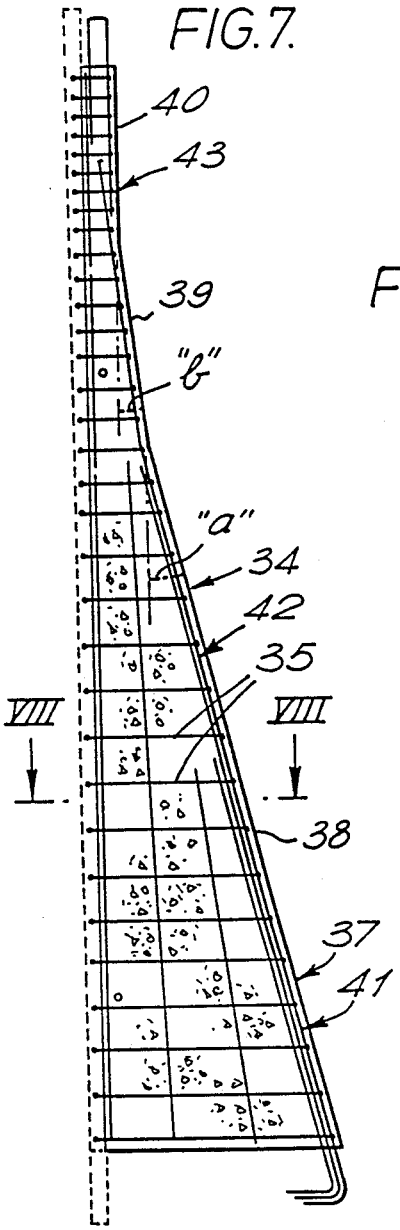
FIG. 7 is a side elevation of a counterfort which is cast separately to a facing panel.
Figure 8:
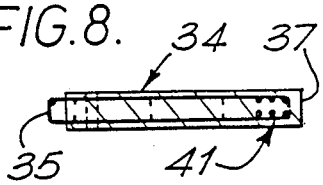
FIG. 8 is a section on the lines VIII—VIII of FIG. 7.

FIGS. 7 and 8 shows a counterfort 34 which is cast separately from the facing panel (shown in dotted lines). The counterfort thus has spaced reinforcing loops 35 projecting from its front face 36 to enable a reinforced concrete connection to be formed with the facing panel when the latter is cast. In this design the rear face 37 of the counterfort is formed in three parts rather than the two parts shown in the previously described embodiment. Thus the rear face has a lower part 38 at an angle "a" to the front face, an intermediate part 39 at a smaller angle "b" to the front face, and an upper part 40 which is parallel to the front face. In the illustrated embodiment angle "a" is $\tan^{-1} 0.25$ whilst angle "b" is $\tan^{-1} 0.13$. By forming the rear face of the counterfort in three differently inclined portions the shape of the counterfort follows a parabolic line related to the bending moment envelope resulting from the loads on the wall and avoids use of extra concrete and steel in the higher regions of the structure where bending moments will be lowest. Such a three part design for the counterfort rear face is particularly suitable for higher walls which may be built from prefabricated elements i.e. walls in the range from 20 to 30 feet (6 to 9 meters).

FIGS. 7 and 8 show details of the steel reinforcement in the counterfort. It will be seen that the bending moment envelope is further taken into account by the provision of the heaviest vertical reinforcement at the rear of the lower region of the counterfort, where typical reinforcement 41 consists of four 8 mm bars and two 9 mm bars for a 30 feet (9 meter) wall. The reinforcement 42 adjacent the intermediate part 39 of the counterfort rear face 37 might consist of two 8 mm bars, whilst the reinforcement 43 adjacent the upper part 40 may also be two 8 mm bars.

For certain applications, the counterfort may have an open web in a region of relatively light loading, for example the area bounded by broken lines shown in FIG. 7.

FIGS. 9 and 10 show a wall element 43 in which the counterfort 44 and the facing panel 45 are cast in a single pour. In this embodiment the rear face of the counterfort is also formed in three parts, namely a lower part 46 at angle "a" to the front of the counterfort, an intermediate part 47 at smaller angle "b", and an upper part 48 which is parallel to the counterfort front. The counterfort differs from that shown in FIGS. 7 and 8 in that it has at its rear a thickened flange 49 in which the rearmost vertical reinforcement 50 is located.

Figure 11:
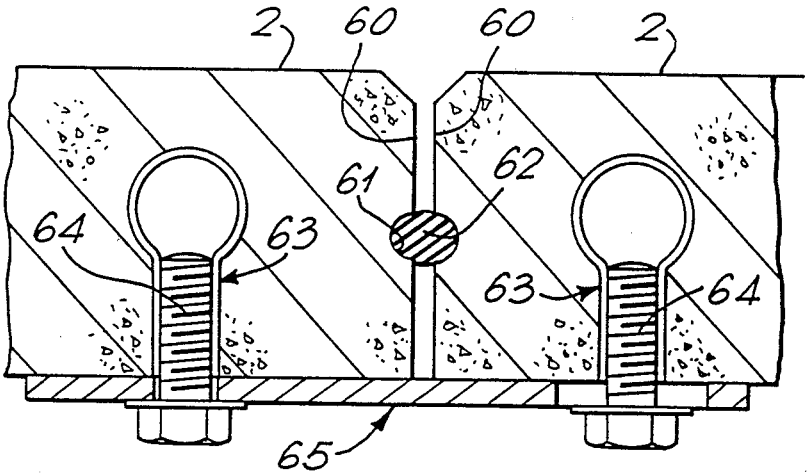
FIG. 11 is a sectional view in a horizontal plane of a first type of connection between adjacent facing panels.
Figure 12:
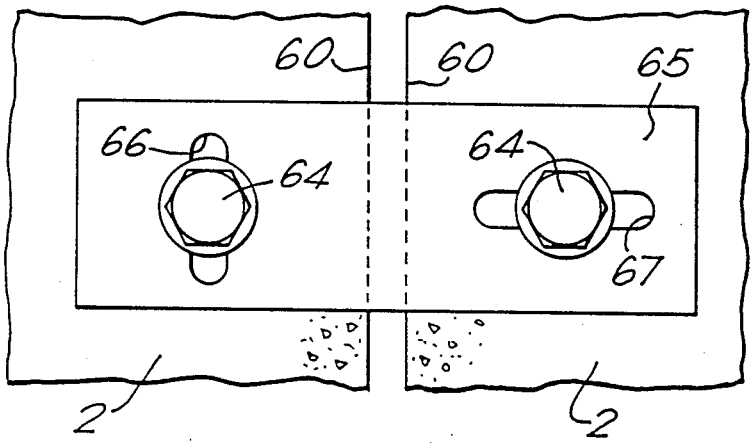
FIG. 12 is a rear view of the connection shown in FIG. 11.

Referring to FIGS. 11 and 12, adjacent facing panels 2 abut at their side edges 60 with an elongate seal member 62 disposed in the vertical slots 61 of the edges. Each facing panel is provided at its rear with a coil insert 63 receiving a respective bolt 64 arranged to tightened on to a connecting plate 65 spanning between the bolts. As seen in FIG. 12 the plate 65 is provided with a vertically extending slot 66 through which passes the bolt 64 associated with one of the panels, and a horizontally extending slot 67 through which passes the bolt 64 associated with the other panel. The vertical slot 66 enables relative vertical adjustment of the adjacent panels prior to tightening of the bolt, whilst the horizontal slot 67 enables the seal member 62 between the panels to be compressed prior to tightening of the other bolt. Depending on the height of the wall, two or more connection plates may be used between each pair of adjacent panels.

Figure 13:
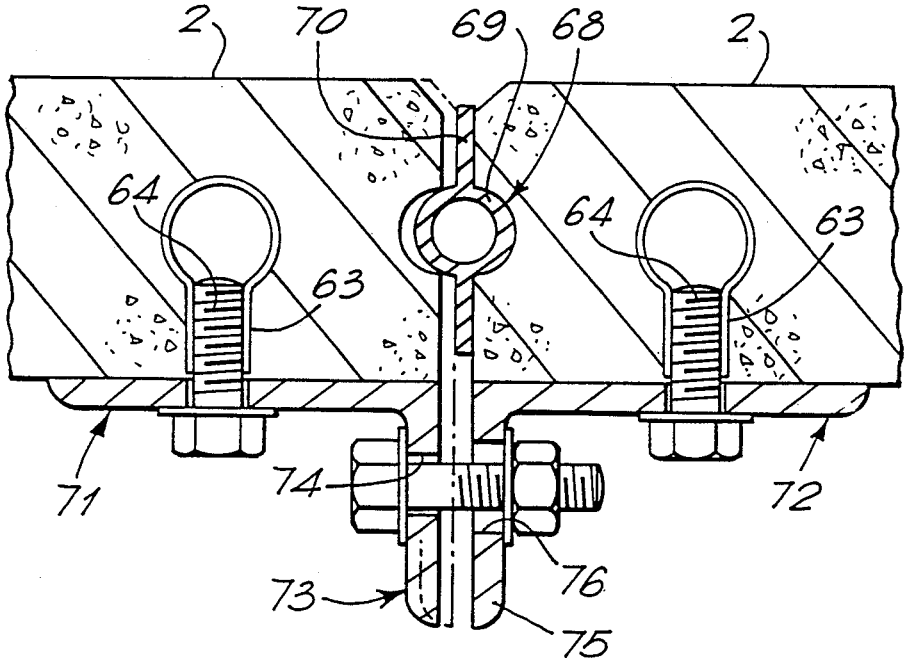
FIG. 13 is a sectional view in a horizontal plane of a second type of connection between adjacent facing panels.

An alternative form of connection between adjacent facing panels 2 is shown in FIG. 13. In this embodiment the seal member 68 comprises a central tube 69 of compressible sealing material which engages in the slots 61 of the panel edges 60 and which is provided in the centre of a sheet 70 of the same material. The sheet 70 acts further to improve the seal formed by the tube 69 by abutment with the edge surfaces of the panels.

As in the previous embodiment each panel is provided at its rear with a coil insert 63 receiving a respective bolt 64. However, instead of a connecting plate, a pair of angle brackets 71,72 are provided. The bracket 71 is bolted by bolt 64 to the left hand facing panel as viewed in FIG. 13 and has a rearward limb 73 in which a vertical slot 74 is provided. The bracket 73 is bolted by its respective bolt 64 to the right hand facing panel and has a rearward limb 75 in which a horizontal slot 76 is provided. The two limbs 73,75 are bolted together by a nut and bolt arrangement 77 and the extent to which this is tightened determines the compression of the seal member 68. The vertical slot 74 in limb 73 allows relative vertical adjustment of the facing panels and the horizontal slot 76 in limit 75 allows relative forward and rearward adjustment of the panels. Thus in this embodiment the panels may be adjusted relative to each other in all three perpendicular directions.

There will normally be at least two connections of the type shown in FIG. 13 between a pair of adjacent panels, and there will be more for higher walls, generally not more than six.

The construction sequence of the retaining wall shown in FIG. 1 will now be described. Wall elements 1 are prefabricated either in two stages, as described with reference to FIGS. 7 and 8, or as a single casting, as described with reference to FIGS. 9 and 10. They are transported to the construction site in a horizontal position with their front faces down. Suitable lifting openings are provided in the elements and these are used to hoist the elements to the upright position.

The shear key 7 is poured on the site and serves as a pad on which the laterally spaced legs 4 of a first wall element 1 are positioned. The erection bolts 32 of the panel legs are adjusted to position the element correctly in the laterally extending plane i.e. the plane of the facing. If necessary bracing may be used at the rear of the element secured rearwards to the ground and having adjustment means to move the top of the element rearwards or forwards.

A second element is then positioned on the shear key 7 adjacent the first element and its erection bolts 32 are in turn adjusted. Either of the previously described connecting systems, namely flat connecting plates 65 or angle brackets 71,72, is then used to secure together the facing panels of the adjacent wall elements, such connections permitting appropriate adjustment of the second element relative to the first.

The process is continued with additional elements and steel reinforcement is positioned ready to pour the concrete of the footing 6. This concrete embeds the upwardly projecting reinforcing bars of the shear key 7 and also the facing panel legs 4 and the downwardly projecting bars 5 of the counterforts. When the footing has hardened the wall is backfilled.

To secure the traffic barrier 23 the concrete fill layer 24 is formed and the barrier is placed on this layer. The junction beam 21 is then cast to form a secure connection between the traffic barrier and each counterfort.

We claim:

1. A retaining wall comprising a facing, a counterfort connected to the rear of the facing, and a footing supporting the facing and the counterfort, wherein: the counterfort comprises a reinforced concrete slab having opposed substantially flat sides and a base portion joined to the footing, a front portion at right angles to said base portion, said front portion being substantially longer than said base portion, and a rear portion running from substantially the top of the counterfort to the rear of the base portion thereof, the angle between the rear portion and the front portion being smaller in the vicinity of the top of the counterfort than in the vicinity of the base; and wherein the facing comprises a plurality of substantially vertical wall elements supported side-by-side on the footing, at least one height adjustment means at the lower edge of each wall element for adjusting the orientation of the element in a lateral plane during construction, connecting means for connecting adjacent elements along substantially vertical side edges thereof, and seal means compressed between such side edges, the connecting means being adjustable during construction in a first direction to vary the compression of the seal means and in a second direction to adjust the relative vertical positions of adjacent elements.

2. A retaining wall as claimed in claim 1, wherein H denotes the height of the wall, and wherein the rear surface of the lower part of the counterfort from the footing to a point in the region 0.5H to 0.63H is at an angle between $\tan^{-1} 0.13$ and $\tan^{-1} 0.25$ to the vertical, the rear surface of the counterfort above that point being at an angle between zero and $\tan^{-1} 0.18$ to the vertical.

3. A retaining wall as claimed in claim 1, wherein there are two changes in the angle of the rear portion of the counterfort, so that the counterfort rear portion has a lower part, an intermediate part and an upper part.

4. A retaining wall as claimed in claim 1, wherein the counterfort further comprises a flange at the rear thereof carrying at least 50% of the total longitudinal reinforcing steel and being of approximately square cross-section joined to the facing by a web of thinner reinforced concrete carrying only nominal reinforcing steel, the thickness of this web being 65–75% of the thickness of the rearward flange.

5. A retaining wall as claimed in claim 1, further comprising backfill behind the facing to provide a support surface, and a barrier along the top of the wall, the counterfort and the barrier being connected to each other whereby any impact loads on the barrier are transferred directly to the footing.

6. A retaining wall as claimed in claim 5, wherein both the counterfort and the barrier are initially provided with reinforcement projecting therefrom, and wherein the counterfort and the barrier are connected to each other by a cast-in-place concrete junction member in which the reinforcement projecting from the counterfort and that projecting from the barrier are embedded.

7. A retaining wall as claimed in claim 5, wherein the barrier comprises precast barrier units which span the junctions between adjacent wall elements to secure these against relative movement.

8. A retaining wall as claimed in claim 1, wherein two height adjustment means are provided at a lateral spacing on the lower edge of each wall element.

9. A retaining wall as claimed in claim 1, wherein the height adjustment means comprises an erection bolt extending vertically downwards from the lower edge of the wall element.

10. A retaining wall as claimed in claim 1, wherein the connecting means for connecting adjacent wall elements comprises a connecting plate secured to the rear of adjacent wall elements, the plate being formed with a horizontal slot through which passes fastening means connected to one of the elements, and being formed with a vertical slot through which passes fastening means connected to the adjacent element.

11. A retaining wall as claimed in claim 1, wherein the connecting means for connecting adjacent wall elements comprises a pair of angle brackets each secured to the rear of a respective adjacent wall element with rearward projecting limbs of the brackets facing each other, each such limb being formed with an opening through which fastening means extends, the opening of one limb comprising a vertical slot and the opening of the other limb comprising a horizontal slot.

* * * * *